US005189956A

United States Patent [19]

Reder et al.

[11] Patent Number: 5,189,956

[45] Date of Patent: Mar. 2, 1993

[54] PRINTING INK FEEDING ASSEMBLY

[75] Inventors: Wolfgang O. Reder, Veitshöchheim; Georg Schneider, Würzburg, both of Fed. Rep. of Germany

[73] Assignee: Koenig & Bauer Aktiengesellschaft, Wurzburg, Fed. Rep. of Germany

[21] Appl. No.: 888,624

[22] Filed: May 27, 1992

[30] Foreign Application Priority Data

May 28, 1991 [DE] Fed. Rep. of Germany ..... 4117389

[51] Int. Cl.[5] ..... B41F 31/02

[52] U.S. Cl. ..... 101/364; 101/366; 101/202

[58] Field of Search ..... 101/364, 367, 366, 365, 101/363, 350, 202, 205, 206, 210

[56] References Cited

U.S. PATENT DOCUMENTS 4,165,688 8/1979 Leanna et al. ..... 101/363
5,003,876 4/1991 Harrison et al. ..... 101/366
5,012,736 5/1991 Kanegan et al. ..... 101/210
5,052,297 10/1991 Albiez ..... 101/365
5,111,747 5/1992 Kobler et al. ..... 101/365

FOREIGN PATENT DOCUMENTS 0227232 7/1987 European Pat. Off. ..... 101/364
0286305 3/1988 European Pat. Off. ..... 101/366
3832183 9/1988 Fed. Rep. of Germany .

*Primary Examiner*—Edgar S. Burr
*Assistant Examiner*—Anthony H. Nguyen
*Attorney, Agent, or Firm*—Jones, Tullar & Cooper

[57] ABSTRACT

A printing ink feeding assembly for an anilox roller uses a plurality of individual anilox inking units. Each unit has its own individual chambered doctor blade, ink trough, ink pump and drive motor. The widths of the units and their positioning beneath the anilox roller are variable to provide flexibility of anilox roller inking.

6 Claims, 1 Drawing Sheet

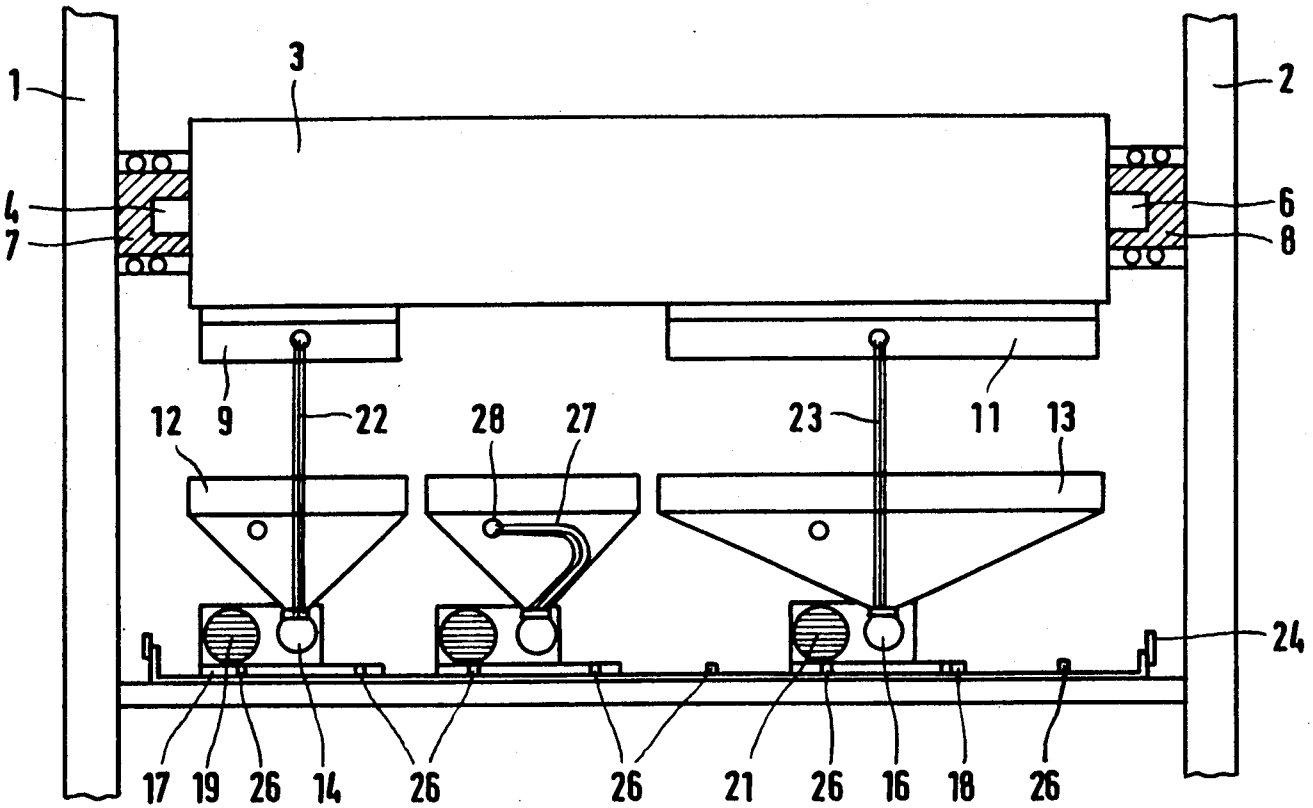
2
6
8
24
13
11
26
18
16
23
26
21
26
27
28
26
22
14
3
26
9
19
12
17
1
4
7

PRINTING INK FEEDING ASSEMBLY

FIELD OF THE INVENTION

The present invention is directed generally to a printing ink feeding assembly. More specifically, the present invention is directed to a printing ink feeding assembly on a printing press. Most particularly, the present invention is directed to a printing ink feeding assembly for an anilox inking roller on a printing press. The printed ink feeding assembly utilizes an anilox roller and a plurality of chambered doctor blades that ar spaced axially along the periphery of the anilox roller. Each chambered doctor blade is supplied with ink from a separate ink trough that has its own variable speed and reversible motor which drives an ink pump. A plurality of such ink troughs and motor and pump assemblies, each of which forms an individual anilox inking unit, are utilized and are interchangeable and repositionable.

DESCRIPTION OF THE PRIOR ART

Inking units for use in printing presses are generally known in the art. An anilox or screened surface ink roller is supplied with printing ink which is then transferred to a plate cylinder or is otherwise used in the printing operation. It is frequently the case that the supply of ink to the anilox roller must be carefully controlled and regulated to insure a high quality printed product. This control may often require the provision of different amounts of ink to different portions of the anilox roller.

In the German patent specification No. 38 32 183 there is shown a prior art anilox inking unit for a printing press. In this device there are shown a maximum of four anilox inking units which are used to supply ink to four chambered doctor blades that are in engagement with the periphery of the anilox roller. These four anilox inking units are all driven from a main drive shaft through fixed coupling units. The main drive shaft extends across beneath the anilox roller and is generally parallel to the axis of the anilox roller. The fixed coupling units are driven by the main drive shaft and, in turn, drive ink pumps in the individual anilox inking units.

In this prior art device, all of the anilox inking units which are positioned across the width of the anilox roller are driven at the same speed through the main drive shaft and the coupling units. This results in an equal quantity of ink being supplied to all of the portions of the anilox roller by the individual anilox inking units. However, the ink requirements of various sections of the anilox ink roller may be different depending on the image being printed and on the consistency of the ink being used. This may result in printing inconsistencies and problems.

In this prior art inking assembly, once one of the anilox inking units has been taken out of operation, but while several of the units remain in operation, it is difficult to return the ink from the now non-operating chambered doctor blade and from its ink feeding line back to the ink trough. This is particularly the case where high viscosity ink is being used. If the ink is allowed to sit in the ink feed line or in the doctor blade, it will be apt to dry out and will thus be difficult to remove.

It will be apparent that a need exists for a printing ink feeding assembly for a printing press which overcomes the limitations of the prior art devices. The printing ink feeding assembly of the present invention provides such a device and is a significant improvement over the prior art devices.

SUMMARY OF THE INVENTION

It is an object of the present invention to provide a printing ink feeding assembly.

Another object of the invention is to provide a printing ink feeding unit for a printing press.

A further object of the present invention is to provide a printing ink feeding assembly for an anilox inking unit.

Yet another object of the present invention is to provide a printing ink feeding assembly for an anilox roller with several anilox inking units arranged side by side along the axial length of the anilox roller.

Still a further object of the present invention is to provide a printing ink feeding assembly in which the ink quantity to each anilox inking unit is individually meterable.

Even yet another object of the present invention is to provide a printing ink feeding assembly in which the individual anilox inking units are easy to clean and avoid ink losses.

As will be discussed in detail in the description of the preferred embodiment which is set forth in detail subsequently, the printing ink feeding assembly of the present invention utilizes a plurality of chambered doctor blades and individual anilox inking units to supply printing ink to the surface of the anilox roller. Each individual anilox inking unit has its own ink trough, ink pump, and reversible ink pump drive motor. Each anilox inking unit is attached to its own base plate and the base plates are removably supported by a support trough beneath the anilox roller.

Each of the individual anilox inking units which are positioned side by side beneath the anilox roller supply the desired quantity of ink to their separate chambered doctor blade. Thus even though different ink consistencies, quantities, and qualities may be required by various portions of the anilox roller, each roller section will be supplied with the ink it needs from its individual anilox inking unit. The result is that the anilox roller is provided with its required ink along its length by the individual anilox inking units in a manner which insures proper printing quality.

The printing ink feeding assembly in accordance with the present invention also increases the operating flexibility of the anilox roller and allows individual anilox inking units to be easily cleaned. The positioning of the individual anilox inking units on the support trough beneath the anilox roller can be varied in accordance with the printing requirements of the printing unit. If a particular anilox inking unit is no longer being operated, its ink pump motor can be reversed and an ink remaining in the chambered doctor blade or the ink supply tubing associated with that unit can be pumped back into that unit's ink trough. This allows the ink to be recovered and the unit to be cleaned. If one of the ink pumps or motors breaks, the individual anilox inking unit can be removed and repaired.

The printing ink feeding assembly of the present invention utilizes a plurality of individual anilox inking units in a manner which overcomes the limitations of the prior art and which provides an substantial advance in the art.

BRIEF DESCRIPTION OF THE DRAWINGS

While the novel features of the printing ink feeding assembly in accordance with the present invention are set forth with particularity in the appended claims, a full and complete understanding of the invention may be had by referring to the detailed description of the preferred embodiment which is presented subsequently, and as illustrated in the accompanying sole drawing figure which is a schematic front view of a printing ink feeding assembly in accordance with the present invention.

DESCRIPTION OF THE PREFERRED EMBODIMENT

Referring to the sole drawing figure, there may be seen a printing ink feeding assembly in accordance with the present invention. An anilox roller 3 is rotatably supported between spaced side frames 1 and 2 of a printing press unit. Anilox roller 3 has suitable axle journals 4 and 6 at its axial ends and these axle journals 4 and 6 are supported in roller bearings 7 and 8 that are attached to the side walls 1 and 2 of the printing press frame. It will be understood that the depicted rotatable support for the anilox roller 3 is exemplary of any suitable support that can be used.

A pair of chambered doctor blades 9 and 11 are shown as being in engagement with the surface of the anilox roller 3. Each doctor blade 9 and 11 is a part of an individual anilox inking unit which will be discussed in detail shortly. Chambered doctor blade 9 is shown as extending along one quarter of the axial length of the anilox roller 3 while doctor blade 11 is shown as extending along one half of the length of the anilox roller 3.

Each chambered doctor blade 9 or 11 has a corresponding ink trough 12 or 13, respectively positioned beneath it. The axial length of each ink trough 12 or 13 corresponds to the axial length of its associated chambered doctor blade 9 or 11, respectively. Each ink trough 12 or 13 tapers generally downwardly and inwardly to the inlet of an associated ink pump 14 or 16, respectively that is associated with its cooperating ink trough 12 or 13.

As may be seen in the sole drawing, each ink trough 12 or 13 and its associated ink pump 14 or 16 is secured to a cooperating base plate 17 or 18. A drive motor 19 is carried on base plate 17 and a similar drive motor 21 is carried on base plate 18. These drive motors are provided with speed regulating or controlling means and are also operable in both directions of rotation. Base plate 17 together with motor 19 and corresponding ink pump 14 constitutes a first driving unit for a first anilox inking unit that includes ink trough 12 and chambered doctor blade 9. Similarly, base plate 18, motor 21 and ink pump 16 constitute a driving unit for a second anilox inking unit that includes ink trough 13 and chambered doctor blade 11. The outlet from the first ink pump 14 is connected to the first doctor blade 9 by an ink feeding conduit 22 such as an ink feeding hose. A similar second ink feeding conduit 23 extends from the second ink pump 16 to the second chambered doctor blade 11.

The first and second anilox inking units are each individually supported on an elongated support trough 24 that extends generally beneath and parallel to the anilox roller 3. A plurality of suitable stud bolts 26 are securely attached to the support trough 24 and extend vertically upwardly, as depicted in the drawing. These stud bolts 26 are receivable in recesses which are not specifically seen, in the base plates 17 and 18 of the first and second anilox inking units. This allows the individual anilox inking units to be shifted about on, and removed from the support trough 24. The drive motors 19 and 21 are connected to their respective ink pumps 14 and 16 by suitable couplings, which are not specifically depicted, so that the ink pumps 14 and 16 can be separated from the motors 19 and 21 and the base plates 17 and 18 for separate cleaning. These couplings could, for example be suitable interchanging tooth type couplings. The ink troughs 12 and 13 are each provided at the bases of their cone shaped outlets with suitable flanges. These flanges are structured to be engageable by inlet connection pieces on the ink pumps 14 and 16. Suitable dowel pins, retaining nuts, and threaded inlet connection pieces on the ink pumps 14 and 16 may be provided. The dowel pins may be received in recesses of the threaded feeding connection pieces of the ink pumps. This assembly will facilitate the efficient and expeditious removal of the ink pumps 14 and 16 from their respective anilox inking units for cleaning and replacement.

In the sole drawing figure there is shown a printing ink feeding assembly having a first anilox printing unit whose chambered doctor blade 9 extends over one fourth of the length of the anilox roller 3 and a second anilox printing unit whose doctor blade 11 extends along one half the length of the anilox roller 3. It is within the scope of the present invention to provide additional individual anilox inking units along the length of the anilox roller 3. As seen in the drawing, a third anilox inking unit could be positioned between the first and second units. Were it to be used, its ink feeding tube 27 would be taken out of a suitable holder 28 on the side of its associated ink trough and connected to a chambered doctor blade similar to the first doctor blade 9.

It is also within the scope of the present invention that as many as four individual anilox inking units may be used with the anilox roller 3. In such a situation, the half width anilox inking unit doctor blade 11 would be replaced by two quarter width blades similar to doctor blade 9. Similarly, the second ink trough 13 and its associated pump 16 and motor 21 would be replaced by two separate units similar to the one used with the first doctor blade 9. The use of four such individual anilox inking units would provide four separate zones for the anilox roller 3 in which the ink could be individually controlled. In a similar manner, the two quarter width units depicted in the drawing at the left side of the anilox roller 3 could be replaced by a single half width unit. Any number of combinations of individual anilox inking units could be used with each of these units having a desired fractional length of the anilox roller 3. Similarly, base plate 17 could be shifted to the right along support trough 24 and could be provided with a new, larger ink trough, a new ink feeding pump and motor and a new, wider doctor blade. The stud bolts 26 are arranged on the support trough 24 to facilitate various positionings of the base plates.

If one of the individual anilox inking units of the present invention is to be taken out of operation, the motor can be operated in reverse to utilize the pump to return the ink in the chambered doctor blade and the ink feed hose back through the pump to the ink trough. This saves ink and allows the individual components to be more easily cleaned. It is possible to clean each of the individual anilox inking units, including ink pump, motor, base plate as well as ink feeding hose, ink trough and chambered doctor blade by placing the entire anilox inking unit in an ink cleansing bath. This complete cleaning can be accomplished so long as an encased electric drive motor is used. The ink cleansing bath can be equipped, for example, with an ultrasonic device.

While a preferred embodiment of a printing ink feeding assembly utilizing individual anilox inking units in accordance with the present invention has been set forth fully and completely hereinabove, it will be apparent to one of skill in the art that a number of changes in, for example, the size of the anilox roller, the types of printing inks used, the types of support journals for the anilox roller and the like could be made without departing from the true spirit and scope of the subject invention which is accordingly to be limited only by the following claims.

What is claimed is:

1. A printing ink feeding assembly on a printing press for feeding printing ink to an anilox roller, said printing ink feeding assembly comprising:

a first ink trough having an ink outlet opening;

a first ink pumping unit removably secured to said ink outlet opening;

a first chambered doctor blade engageable with the anilox roller and having a length less than an axial length of the anilox roller;

first ink feeding means for feeding ink to said chambered doctor blade from said first ink trough through said first ink pumping unit; and a first base plate removably securable to a support trough of the printing press, said first base plate carrying said first ink trough, said first ink pumping unit, and said first ink feeding means, and forming a first anilox inking unit, said first anilox inking unit being shiftably positionable with respect to said anilox roller.

2. The printing ink feeding assembly of claim 1 wherein said first ink pumping unit includes a first ink pump and a first drive motor, said first drive motor being operably connected to said first ink pump and said first ink pump being removably secured to said ink outlet opening of said first ink trough.

3. The printing ink feeding assembly of claim 1 wherein said first base plate is provided with spaced recesses and further wherein said support trough is provided with spaced studs, said studs being receivable in said spaced recesses.

4. The printing ink feeding assembly of claim 2 wherein said first ink pump is a speed regulatable and reversible motor.

5. The printing ink feeding assembly of claim 1 further including a second anilox inking unit. said first and second anilox inking units being of a collective length less than an axial length of the anilox roller.

6. The printing ink feeding assembly of claim 5 wherein said first and second anilox inking units ar positionable adjacent each other on said support trough.

* * * * *